United States Patent [19]

Guins

[11] Patent Number: 4,765,251

[45] Date of Patent: Aug. 23, 1988

[54] RAILWAY CAR TRUCK WITH MULTIPLE EFFECTIVE SPRING RATES

[75] Inventor: Sergei G. Guins, Okemos, Mich.

[73] Assignee: Kaser Associates, Inc., Okemos, Mich.

[21] Appl. No.: 904,074

[22] Filed: Sep. 4, 1986

Related U.S. Application Data

[63] Continuation of Ser. No. 633,590, Jul. 23, 1984, abandoned.

[51] Int. Cl.[4] ..... B61F 5/06

[52] U.S. Cl. ..... 105/197.05; 267/4

[58] Field of Search ..... 105/197.05, 197.1, 197.2; 267/3, 4

[56] References Cited

U.S. PATENT DOCUMENTS

| | | | |
|---|---|---|---|
| 1,930,630 | 6/1931 | Symington | 105/197.05 |
| 1,973,663 | 9/1934 | Shafer | 105/197.05 |
| 2,354,458 | 8/1942 | Hammerstrom | 105/197.05 |
| 3,762,694 | 10/1973 | MacDonnell | 105/197.05 |

*Primary Examiner*—Robert B. Reeves
*Assistant Examiner*—Frank Williams
*Attorney, Agent, or Firm*—Gifford, Groh, VanOphem, Sheridan, Sprinkle and Dolgorukov

[57] ABSTRACT

The specification discloses an improved railway car truck providing increased dampening for high volume rail cars by the use of bolster pocket wear plates in combination with five different types of springs in the spring baskets of the railway car trucks. The five different types of springs include either a single outer coil, or inner and outer coaxial coils, with the outer coils being of different lengths to provide multiple effective spring rates action which place the critical frequency of the car trucks at two different speeds, rather than a single speed, and makes the amplitude of resonance occurring at the critical frequency much smaller than would otherwise occur, to prevent the car truck from resonating in such a way as to rock the rail car excessively. These types of spring arrangements also prevent excessive vertical bouncing of railway cars.

21 Claims, 4 Drawing Sheets

RAILWAY CAR TRUCK WITH MULTIPLE EFFECTIVE SPRING RATES

CROSS-REFERENCE TO RELATED APPLICATIONS

The present application is a continuation of my co-pending U.S. Letter Patent application Ser. No. 06/633,590 now abandoned, filed July 23, 1984, for "Railway Car Truck with Three-stage Bolster Springs". The filing date of said co-pending application is specifically claimed herein.

BACKGROUND OF THE INVENTION

2. Field of the Invention

The present invention relates to improved railway car suspensions, and more particularly to improved means for stabilizing or dampening the load supporting spring suspension of a railway car so as to prevent the build up therein of vibration frequencies of objectionable amplitudes which can cause excessive swaying, rocking or bouncing of the rail car, especially of the new high volume rail cars, and can be dangerous when excessive.

It is well known that a railway car can be bounced vertically by several forces as the railway car proceeds down a railway track in operation. Most pronouned of these forces is the vertical bouncing produced when the wheels of the railway car pass over the rail joints of the track way. Other types of vertical forces can be imparted by objects on the railway track, or flat spots on the railway car wheel, etc.

It is this bouncing action that sets up forced vibrations in the spring suspension assembly of the railway car truck. This, in combination with the natural frequency of the springs of the railway car truck, determine the critical frequency of the car truck, and when the car truck is operated at speed at which this critical frequency occurs, an objectionable and dangerous bouncing action is set up in the spring suspension of the car truck. Even at speeds other than the critical frequency, it is desirable to minimize the forced vibrations incident to the car truck construction.

The earliest way to do this was to place the joints in the rails so that the rail joints on one side of the track are midway of the joints on the other side of the track. Since the bouncing by traveling over the rail joints are the main forces acting on the car truck, this minimized any vibrations incident to the track construction, and at this point one had to just make sure that the rail car truck was not operated at a speed to cause the critical frequency to be reached.

However, in addition to the spring vibrations incident to the vertical bounce of the car, there are other forced vibrations which are equally undesirable, such as, for example, the vibrations incident to the lateral swaying or roll of the car body, or the fore and aft lurching of the car body. All of these shock waves, and the forced vibration frequencies resulting therefrom vary in relation to the weight of the load, the center of gravity as effected by the density of such load, and the speed of operation. It was, therefore, found that the expedient of placing track joints on alternate sides of the track was not enough to provide a smooth riding suspension for a railway car. This was especially true when one considers the difference in weight between a loaded and an unloaded car, and now with the advent of the high volume or high-cube cars, the forced vibrations which could be set up by swaying or lurching of the car, and the effects of forced vibrations set up by the rail joints are even more undesirable.

2. Description of the Prior Art

Prior to the present invention, many remedies have been tried to provide additional dampening force, and thus minimize the undesirable effects of these forced vibrations. My own prior U.S. Pat. No. 2,873,691 entitled, "Stabilizing Structure for Railway Car Spring Suspension" discloses a system particularly adapted for removing objectionable forced frequencies by the utilization of friction dampening means, together with different length springs to provide a different springing effect for loaded and unloaded railway cars. Because the inner and outer springs used are of two different lengths, this is known in the art as providing two-stage springing. My prior art patent provided a satisfactory solution to the problem of how to provide a railway car truck suspension which would provide satisfactory operation without objectionable resonance, both in a loaded, and unloaded, railway car.

My U.S. Letters Patent No. 4,333,403 entitled, "Retainer Railway Car Truck Bolster Spring" also relates to this problem, and provides a more satisfactory way of holding the inner coil spring in relation to the outer coil spring.

However, as the need for increased efficiency made itself felt in the American railway industry, thus forcing the move to larger and larger volume box cars, and resulting in what is known as the high volume or high-cube car, this type of railway truck suspension was not adequate, as the additional height of the car made the truck suspension acutely susceptible to forces providing objectable roll during operation of the railway car.

Essentially, two operational problems are encountered in the movement of, for example, one hundred ton high volume covered and open top hopper cars. One of these is the tendency of the cars to rock excessively when loaded, and the other problem is the operation of these cars empty.

Attempts to provide additional dampening took two directions. The use of non-linear, variable, fixed springs to control vibration of these freight cars was attempted without success due to the lack of space, and the need to control coupler height.

Thus, the only other solution that was found satisfactory was to utilize addtional hydraulic dampening or snubbing devices. However, this solution is not satisfactory because it results in the spring deflection of empty cars being very small, causing the aforementioned excessive rocking, and the very heavy spring rates needed give an objectionable ride under partially loaded conditions.

SUMMARY OF THE INVENTION

In order to solve the problems long standing in the art, the present invention uses a railway car truck suspension having multiple effective spring rates within the spring basket. The use of single and two-stage springs prevents the build up of objectionable forced vibrations as the load and speed of operation of the railway car varies by having the single and two stage springs engaged at different load conditions, thereby providing a suspension having multiple (three) effective spring rates.

Thus, it is an object of the present invention to provide an improved railway car truck construction which will provide adequate and variable effective dampening force for controlling the forced frequencies applied to a railway car truck.

A further object of the present invention is to eliminate the tendency of high volume hopper cars to rock excessively when loaded or empty.

A further object of the present invention is to provide a railway car truck suspension having a sufficient effective dampening force for use on high volume railway cars without the use of hydraulic or other type of supplementary snubbers.

A further object of the present invention is to improve the ride quality and operational safety of high volume railway cars when operated empty.

A further object of the present invention is to provide vibration control for high volume railway cars when operated loaded, thereby minimizing the tendency to rock at low speeds.

A still further object of the present invention is to provide a railway car truck suspension of the foregoing nature using single stage and two-stage springs.

A still further object of the present invention is to provide a railway car truck suspension providing improved ride control for high volume box cars without the need for excessive maintenance.

A further object of the present invention is to provide and improved railway car truck suspension which is resistant to resonance at objectionable frequencies, and is relatively simple and inexpensive to manufacture.

Further objects and advantages of this invention will be apparent from the following description and appended claims, reference being made to the accompanying drawings forming a part of this specification, wherein like reference characters designate corresponding parts in several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENT

Figure 1:
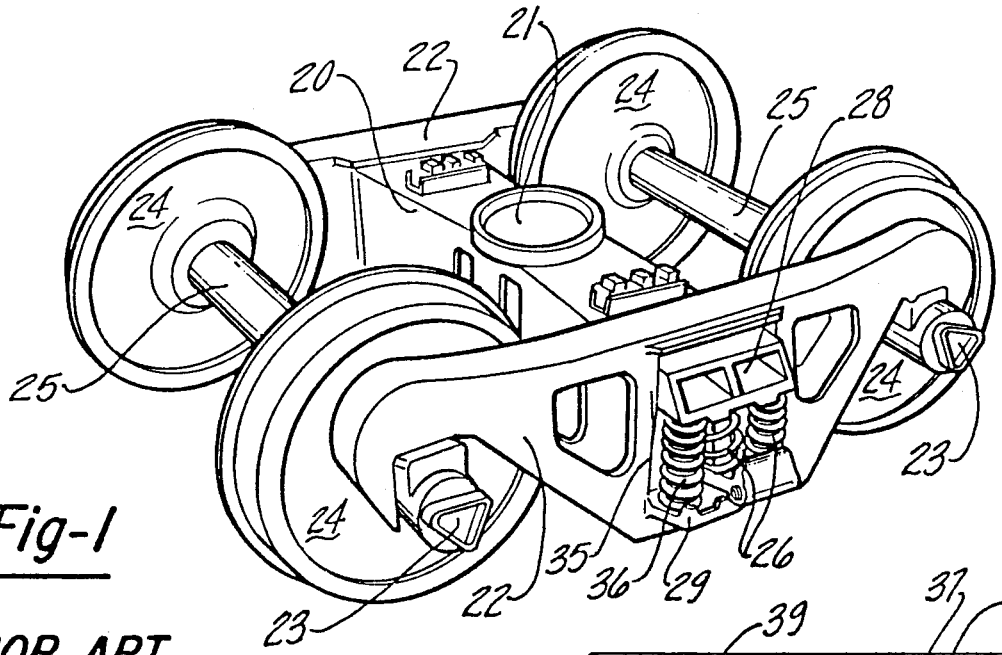
Fig-1 PRIOR ART
FIG. 1 is a perspective view of a prior art railway car truck suspension showing the use of hydraulic snubbers to provide supplemental snubbing.

Referring to FIG. 1, there is shown a typical railway truck in use today. The truck consists of a bolster 20 having a center plate 21, a pair of side frames 22 mounted on the journal structures 23 of four wheels 24. A pair of wheels 24 are connected by axles 25 and a group of load springs 26 and stabilizer springs 27 (FIG. 2) are carried between the end portion 28 of the truck bolster 20 and the side frame extension 29, both of which extend through the bolster window 35. Trucks which are in use on high-cube cars to prevent the unnecessary roll and resonance which are the subject matter of the present invention have supplementary snubbing in the form of the hydraulic snubbers 36 which take the place of one or more of the load springs 26.

To provide the necessary dampening, many of the trucks in use today, and the railway trucks of the present invention, may have an additional stabilizing structure as described in my aforementioned U.S. Pat. No. 2,873,691, the disclosure of which is specifically incorporated herein by reference. In this construction, a wedge-shaped portion 37 of the bolster 20 is provided, which is smaller than the bolster window 35.

At the side of the bolster window 35 are provided wear plates 38, and interposed between the wedge-shaped portion 37 and the wear plates 38, are wedge members 39. It can be seen that as vertical forces are applied to the bolster 20, and thus to the wedge-shaped portion 37 of the bolster, horizontal and vertical forces are applied to the wedge members 39. The vertical forces are applied to the stabilizer springs 27, while the horizontal forces are applied to the wear plates 38. The friction between the wedge members 39 and the wear plates 38 provides additional dampening force.

However, it has been found that even more dampening force is needed than has heretofore been provided because of particularly critical resonance conditions which are found during the operation of high-cube cars. Resonance is the effect produced when the natural vibration frequency of a body, in this case the springs in the railway truck, is greatly amplified by reinforcing vibrations at the same or nearly the same frequency from another body. In this case, the outside forces mentioned before, and most notably the forces provided by the railway truck traveling over rail joints.

Figure 4:
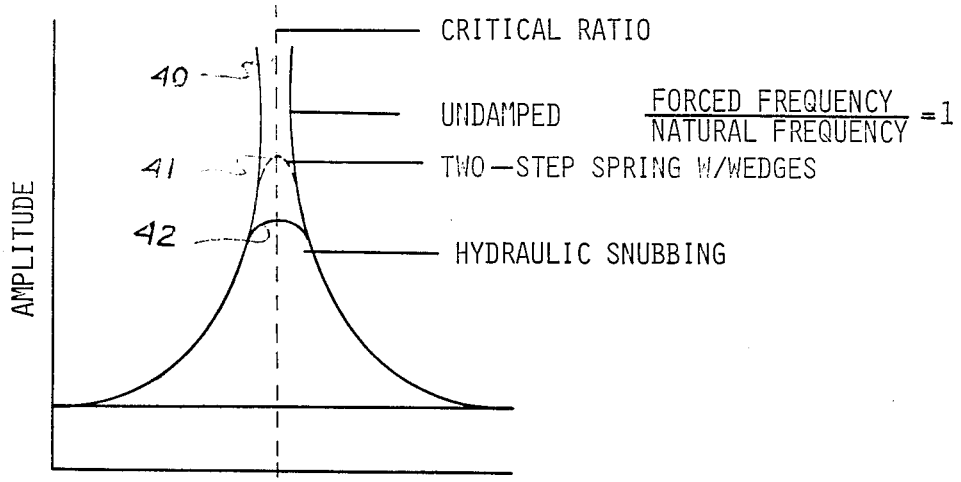
PRIOR ART Fig-4
FIG. 4 is a chart showing resonance conditions for various prior art railway car truck constructions.

As shown is FIG. 4, the amplitude of the resonance which will be produced in a railway car truck can be plotted against the ratio of the natural frequency over the forced frequency. The natural frequency can be found for any particular condition by the formula:

$f=\frac{1}{2}pi\times[(Kg/w)]^{\frac{1}{2}}$, where f=frequency,

K=spring rate in pounds per inch of deflection, g=gravity, w=the load in pounds.

The forced frequency applied to the railway car trucks is calculated in terms of the railway joint spacing, since this is the major force effecting the operation of the railway car. For ease of illustration, the other forces are not considered in this discussion.

The forced frequency=(MPH×5280)/(3600×RJS), where

MPH=miles per hour,

RJS=rail joint spacing.

It can be seen by FIG. 4 that when the ratio of the natural frequency to the forced frequency is equal to one, uncontrolled resonance occurs, which can result in loads being periodically completely removed from the wheels of a railway car truck, and in extreme situations can cause such rocking and lurching of the rail car as to derail the same. Thus, the portion of the chart indicated by the numeral 40, which is for a rail car truck with no snubbing, provides a completely undesirable condition.

It can be seen that by first calculating the natural frequency, and then setting the forced frequency equal to the natural frequency, the speed at which resonance will occur can also be calculated.

Figure 2:
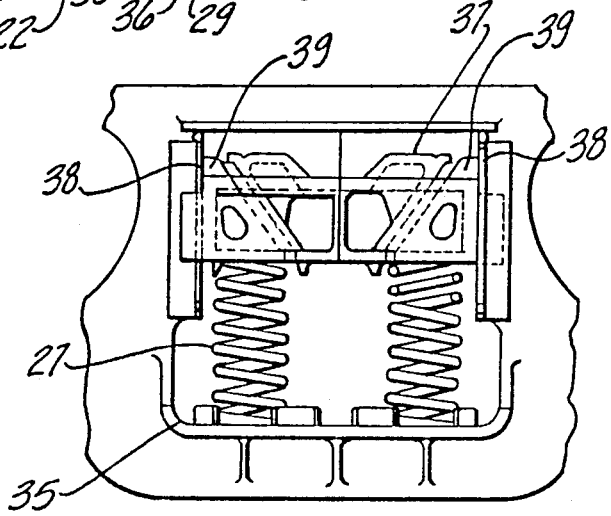
Fig-2 PRIOR ART
FIG. 2 is a cut-away elevational view showing wedge means for applying variable frictional forces within the railway car truck to damp vibrations of variable frequencies in said suspension, said construction being used in the prior art, and also in the present invention.
Figure 3:
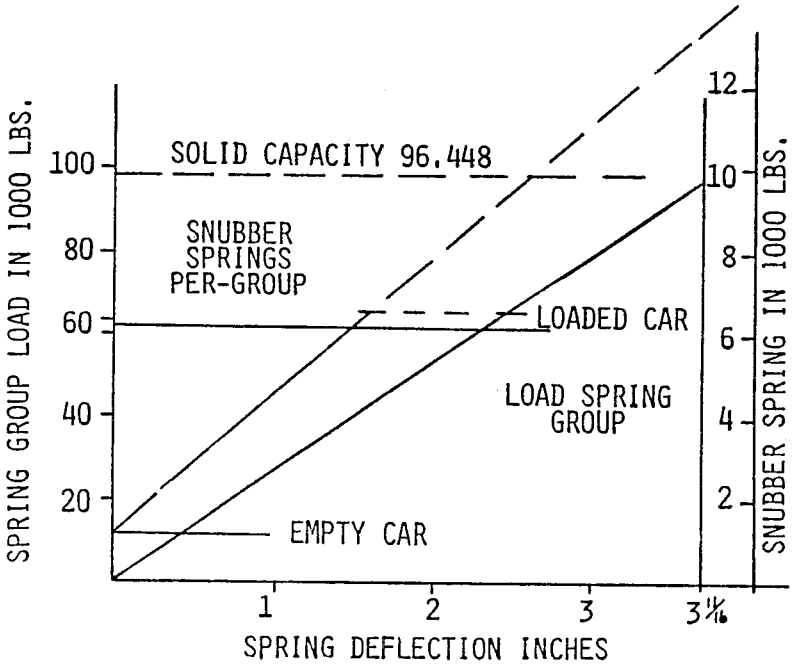
Fig-3 PRIOR ART
FIG. 3 is a chart showing spring deflection in inches versus spring force for load and snubber springs as used in the prior art for empty, loaded and solid capacity conditions.

The curve labeled 41 is a representative curve showing the effect of adding the wedge members shown in FIG. 2. It can be seen that the amplitude of the resonance will not exceed a particular value regardless of the speed of the railway car, and this provided some relief in standard sized box cars utilizing the features of my U.S. Pat. No. 2,873,091, wherein better control was had of the ride of the railway car, both in its loaded and unloaded conditions.

However, with the event of high-cube cars having very heavy loads, the additional dampening provided by the wedge members 39 bearing against the wear plates 38 was inadequate, and railway cars equipped with such trucks would not pass tests prescribed by the Association of American Railroads. Thus, others concerned with this problem provided supplemental hydraulic snubbers which produced the curve labeled 42 in FIG. 4. Thus, the maximum amplitude of vibration is reduced still further to an acceptable level for such rail cars.

However, this solution is not entirely satisfactory. The provision of hydraulic snubbers represents initially much higher cost, and they have been found nearly impossible to maintain. In many cases they are impossible to check because they are located as one of the inner springs of a group of springs, and even if they are easy to check, there is no practical way to keep a continual eye on them to look for leaks. If the hydraulic fluid leaks out of these snubbers, they provide no dampening force at all, and in an extreme case, the curve for a particular railway car may look like that indicated by the numeral 40, and dangerous conditions may be set up.

Figure 5A:
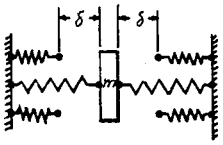
FIG. 5A is a diagrammatic view of a dual-stage spring system.
Figure 5B:
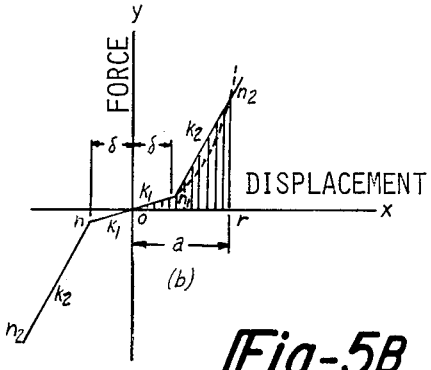
FIG. 5B is a graph showing displacement versus force for the spring system shown in FIG. 5A.
Figure 5C:
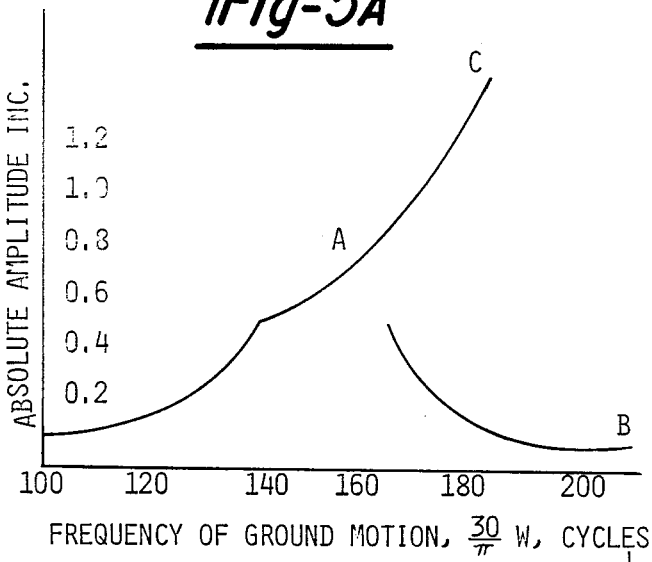
FIG. 5C is a simplified graph showing the amplitude versus the frequency of ground motion in cycles per minute for my multiple effective spring rate system.

From my previous work in railway car suspensions, I was familiar with the theory of operation of two-stage springs, and was convinced that an application of this theory to produce a truck having a multiple spring rate may be the solution to the problem of eliminating undesirable resonance in high-cube railway cars without introducing serious cost and maintenance problems. A good reference work to consult concerning this type of springing is the book entitled, "Vibration Problems in Engineering" by S. Timoshenko, Second edition, by D. Van Nostrand & Co. Pages 137–147 deal with non-linear springs in general, and pages 145–147 are particularly pertinent to two-stage springs as used in the present invention, where abrupt changes in stiffness occur during oscillation of the system. FIGS. 5A–5C of the present application are based on FIGS. 94 and 95 from the Timoshenko book.

It can be seen by referring to FIGS. 5A and 5B, that when springs of two different lengths are present, after a certain displacement, the force required for a further displacement rises abruptly as the two additional springs are being compressed with the one longer spring. As shown by FIG. 5C, the resonance condition no longer approaches infinity in this type of spring system, as it does in FIG. 4, but instead is discontinuous, with the discontinuity occurring at a rather small amplitude. It has been my experience, based on experimentation, that a railway car truck suspension being accelerated slowly from rest will follow the portion of the curve labeled A, and then proceed upward on the portion of the curve labeled C as its spped increases, and then continue on the portion labeled B.

A railway car truck which is decelerating from a high speed will never utilize part C of the curve, but will decelerate along the portion labeled B, cross over the discontinuity, and continue on the portion of the curve labeled A. Even on the portion labeled C, compared to a single-stage springing, the resonance condition is much improved over the condition illustrated in FIG. 4. However, I did not find it possible to further improve the springing shown in my previous U.S. patent to the extent necessary for use in high volume rail cars. Thus, I decided that at least a third set of springs, to produce at least three different effective spring rates during the compression of the railway car truck was necessary.

Figure 8:
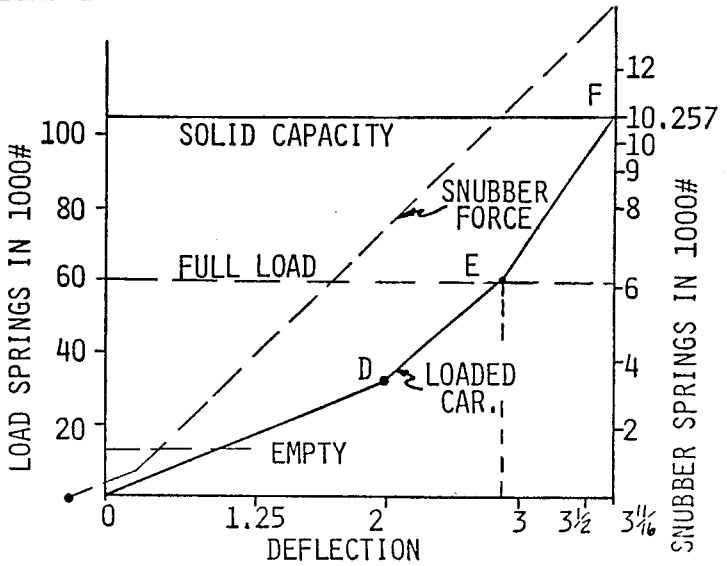
FIG. 8 is a chart, similar in part to FIG. 3, but showing spring deflection in inches versus force for the snubbing springs and other springs utilized in my invention under empty, full load, and solid capacity conditions.

After much experimentation, I developed a set of springs having the multiple spring rate characteristics shown in FIG. 8. It can be seen that as the spring deflection in inches increases, the amount needed to produce an additional deflection increases in two phases. The original spring rate of the spring group, together with the new spring constants which are present at each of these two new phases, gives each spring group three effective spring rates. Thus, FIG. 8 is similar in part to FIG. 5B, but has an additional portion.

Figure 5D:
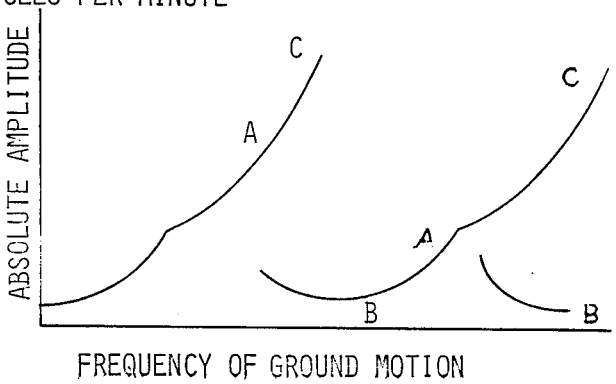
FIG. 5D is a simplified graph showing the amplitude versus the frequency of ground motion in cycles per minute for my multiple effective spring rate system.

To arrive at a spring group having multiple spring rate characteristics, I have used the principles shown in FIG. 5A by placing the longer spring shown therein inside and coaxial with a larger diameter, but shorter, outer spring to provide a two-stage spring suitable for railway car truck use. By utilizing such a two-stage spring, in various configurations having different length outer springs, as will be explained below, multiple effective spring rates are produced within a spring group. It can be seen that by using two different two-stage springs within a spring group, the curve of FIG. 8 can be produced. It can be understood that by using additional, but different, two-stage springs within a spring group, more than three effective spring rates can be produced. Using for ease of illustration a spring group having two different two-stage springs in addition to single stage springs, it is my belief, based on the application of the above theory to the additional change in spring constant present in my system, that an additional discontinuity will appear in FIG. 5C at the point the third effective spring constant comes into play, as shown in FIG. 5D, thus giving peak resonance at two different speeds, but at such low values that the operation of the railway car is not adversely effected by operation at either speed.

In attempting to put this theory into operation, it was found that not only were additional sets of two-stage springs needed, but that in some cases the friction wedge construction previously discussed was also needed to give staisfactory results. Also, the arrangement of the springs within the bolster window proved important.

Figure 6:
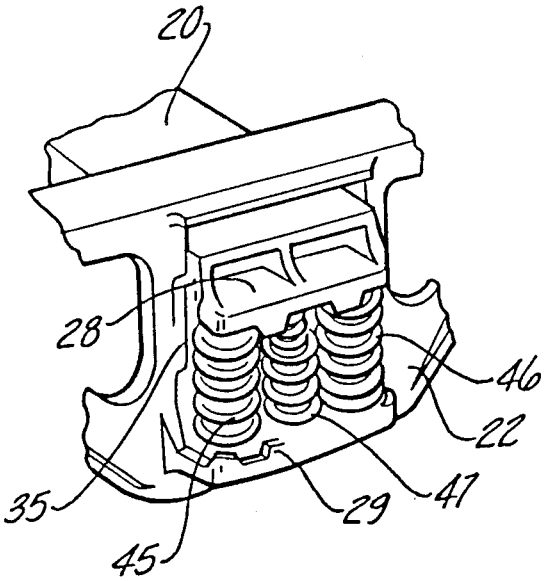
FIG. 6 is a partial perspective view of a rail car truck embodying my invention.

Referring now to FIG. 6, there is shown a partial cut-away view of a railway car truck similar to that shown in FIG. 1. Most portions of the standard rail car truck are retained in the present invention. There is illustrated a first truck element in the form of a pair of side frames 22 for supporting a group of load springs. A second truck element in the form of a bolster 20 is supported by the load springs in the bolster window 35.

As before, the end portion 28 of the bolster 20, and the side frame extention 29, operate to constrain a spring group. In this case, however, the spring group includes five different types of springs, as can be seen by referring to FIG. 7.

The first load springs (designated by the numeral 1 in FIG. 7) are indicated by the numeral 45 Likewise, the second load springs (designated by the numeral 2 in FIG. 7) are indicted by the numeral 46, the two-stage third load springs (designated by the numeral 3 in FIG. 7) are designated by the numeral 47, and the two-stage fourth load spring (designated by the numeral 4 in FIG. 7) is designated by the numeral 48. The linear stabilizer springs (designated by the numeral 5 in FIG. 7) in this instance are indicated by the numeral 49, and supply additional dampening force in the same manner as the linear stabilizer springs indicated by the numeral 27 in FIG. 2, but have an additional coaxial inner coil due to the higher forces involved.

Although not always necessary, in many cases it has proven desirable to provide said stabilizing structure for a railway car suspension. In the illustrated embodiment of the present invention the stabilizing structure for a railway spring suspension structure illustrated in FIG. 2 is used in its entirety, except linear stabilizer springs 49 are used, instead of stabilizer springs 27.

Returning to FIG. 6, it can be seen that the springs visible on the outside of the railway car truck are a first load spring 46, a, two-stage third load spring 47, and a second load spring 46. The details of these springs are disclosed in FIGS. 9–12. It should be understood that the dimensions given for these springs are illustrative only, and that the spring constant, coil diameter and length of one or more of the springs may vary depending upon the particular application to which the railway car truck containing these springs is to be put. Of importance are the fact that FIGS. 9–12 are laid out with a common base line so that the various relative heights of the springs as installed in the bolster window can be clearly seen, with the continued deflection and compression of the spring group in the bolster window successively engaging the heavier outer coil springs, and giving the steps in the curve shown in FIG. 8, i.e., the multiple effective spring rates.

Figures 9, 10, 11, 12:
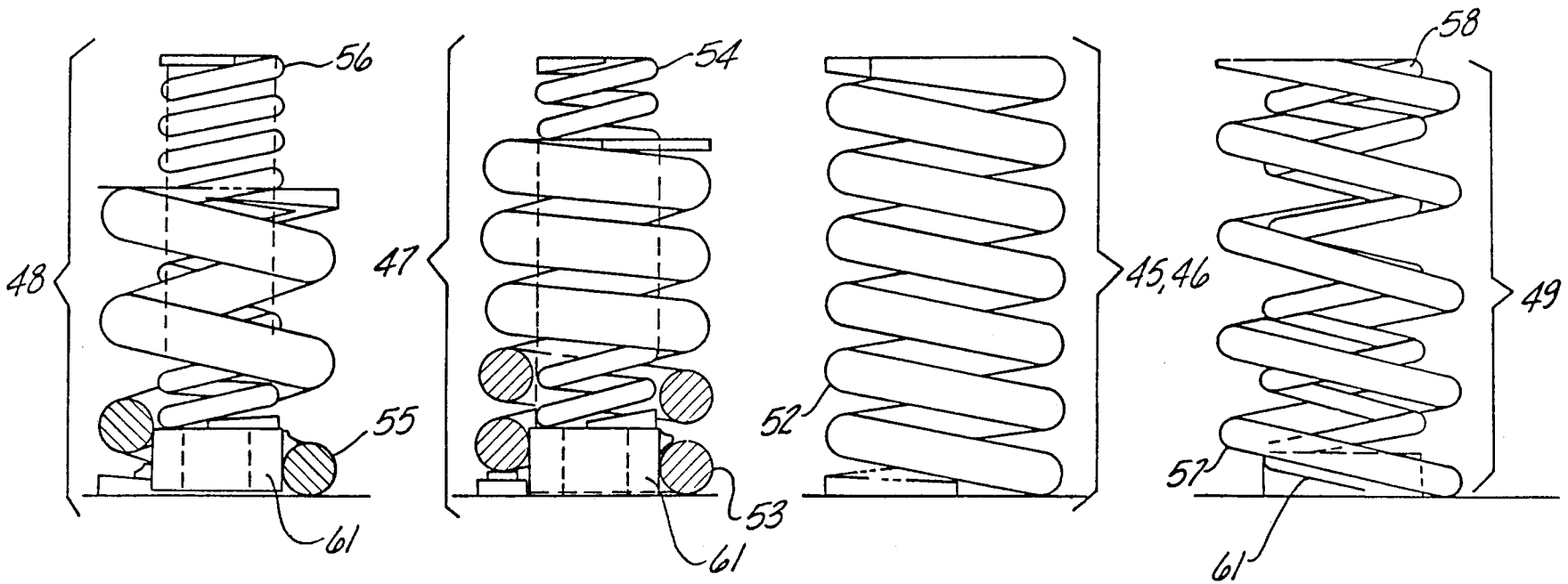
FIG. 9 is an elevational view of the spring represented by the numeral 4 in FIG. 7.
FIG. 10 is an elevational view of the springs represented by the numeral 3 in FIG. 7.
FIG. 11 is an elevational view of the springs represented by the numerals 1 and 2 in FIG. 7.
FIG. 12 is an elevational view of the snubber springs represented by the numeral 5 in FIG. 7.

FIG. 11 represents both the first and second load springs (45 and 46) which are identical, except that the second load spring 46 may have a coaxial inner spring (not shown), if needed, and in this illustration have an installed height of 10¼ inches, and are designated for a total deflection of 3 11/16 inches. The springs have a spring constant of 16,285 pounds per inch (Standard AAR D5 springs). These springs are selected to provide adequate suspension for an empty car according to the values shown in the chart of FIG. 8.

Figure 7:
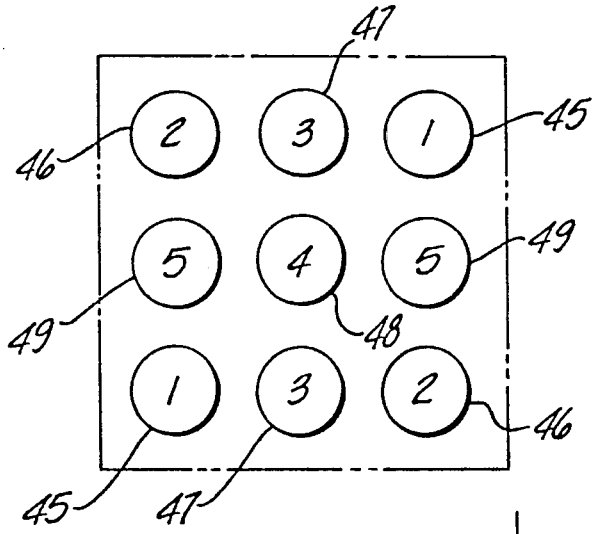
FIG. 7 is a plan view showing the arrangement of the springs of the railway truck shown in FIG. 6.

The two-stage third load spring 47 is illustrated in FIG. 10, and consists of an outer coil 53 of the same dimension as spring 52, an inner coil 54 having dimensions of 8 11/16 inches in length and 2 3/8inches in diameter, and a wire diameter of 23/32 of an inch. As can be seen in FIG. 7, there are two of such two stage third load springs 47. These springs, working together with springs 45 and 46, provide adequate suspension for a loaded car, with a spring rate of 36,602 pounds per inch as shown in FIG. 8.

The fourth two stage load spring 48 is illustrated in FIG. 9, and consists of an outer coil 55 having the same wire diameter as coils 52 and 53, but being of a height of 7.4 inches. The inner coil of the two-stage fourth load spring is indicated by the numeral 56, and has a height of 8 11/16 inches, a diameter of 2 7/8 inches, and is made of bar stock having a diameter of 7/16 of an inch. It is this fourth load spring 48 working in combination with the first and second load springs, 45 and 56 respectively, and the third springs 47, which provides the third of my multiple effective spring rates to control the dynamics of a loaded high volume car.

The linear stabilizer spring 49 is illustrated in FIG. 12, and has an outer coil 57 having an installed height of 10.25 inches, a diameter of 3⅞ inches, and is made out of spring stock havig a diameter of 23/32 of an inch, while the inner coil 58 is 2⅜ inches in diameter, having a free standing height of 9.57 inches, and is made out of a spring stock having a diameter of 13/32 of an inch. It is to be noted that all of the inner springs may be of varying heights, and they may be brought to the uniform required height of 10.25 inches by being mounted on retainers 61 which may be the same as disclosed in my U.S. Pat. No. 4,333,403, if desired.

For the particular set of springs illustrated, and assuming a rail car weighing 263,000 pounds and having an unsprung mass of 17,000 pounds, an empty car will have a spring deflection of 0.439 inches, while a fully loaded car will have a spring deflection of 2.35 inches, with the force necessary to produce the deflections being that shown in FIG. 8. The portion of the curve from the origin through the point labeled D shows the force required to produce the indicated spring deflection in inches, while the coils 52 of the first load spring 45 and the second load spring 46 are engaged, together with outer coil 57 and inner coil springs 54, 56 and 58, while the portion of the curve D–E shows the force required to produced deflection when the outer coil 53 of the two-stage third load springs 47 become engaged, while the portion of the curve E–F shows the extremely high rate of force needed to produce additional deflection when the outer coil 55 of the two-stage fourth load spring 48 becomes engaged. In other words, the first phase of the three effective spring rates produced by the embodiment shown comes into effect when springs 45, 46, 54, 56, 57 and 58 are active, the second phase of the multiple effective spring rate becomes effective when springs 45, 46, 53, 54, 56 and 58 are in operation, while the third phase of the multiple effective spring rates come into effect when springs 53, 54, 55, 56, 57 and 58 are active.

Experimentation has shown that for this particular spring group, applied as illustrated, the roll of a particular high-cube railway car was greatly reduced. Similar results are expected in many applications using my invention.

The above illustrated spring arrangement was for a particular group of cars. Other arrangements may be needed for other types of cars with high centers of gravity, such as flat cars with highway trailers.

Thus, by applying the theory of non-linear springing, and by utilizing one or more different two-stage springs within a spring group used in a railway car truck, I have provided that resonance never approaches dangerous levels, and have overcome long standing problems in the art.

I claim:

1. A railway car truck including a plurality of spring groups, a side frame on which said spring groups are supported, and a bolster moveable relative to said side frames and supported by said spring groups for transmitting the load weight of the car to said spring groups, each of said spring groups including:

(a) a plurality of single stage springs of a sufficient number to support an empty or lightly weighted railway car, each of said single stage springs consisting of an outer coil and an inner coil of the same height, and (b) a plurality of two-stage springs, which in combination with said single stage springs provide the specified total capacity of the spring group required by the railway car capacity, wherein each of said two-stage springs include an outer coil, a retainer integrally wound on the outer coil, and an inner coaxial coil mounted on said retainer, said inner coil being under compression, and the combination of the inner coil and retainer preventing lateral displacement of the outer coil.

2. In a railway car truck including a pair of side frames having bolster windows for receiving a bolster therein, each of said bolster windows having a side frame extension for receiving a spring group, and a bolster having end portions to receive said spring groups operatively mounted to said side frames, with each of said spring groups being operatively interposed between said bolster end portions and said side frame extensions, the improvement comprising each of said spring groups providing multiple effective spring rates by utilizing a combination of single stage and two-stage springs operating in parallel, wherein each of said two-stage springs comprises an outer coil, a retainer integrally wound on the end of said outer coil, and an inner coaxial coil mounted on said retainer, said inner coil being under compression, the combination of the inner coil and retainer preventing lateral displacement of the outer coil, said outer coil being of a height shorter than said bolster window, and wherein each of said bolster windows is of a uniform height with respect to said single stage and said two-stage springs.

3. The device defined in claim 1, wherein each one of said spring groups includes:

(a) at least one single stage first load spring and at least one single stage second load spring, which, in combination, provide adequate spring suspension for an empty car;

(b) at least one two-stage third load spring which, in combination with said first and said second load springs, provide adequate suspension for a loaded car;

(c) at least one two-stage fourth load spring which, in combination with said first and said second single stage load springs and said two-stage third load spring, provides a third stage of said multiple effective spring rate to control the dynamics of a loaded car; and (d) at least one stabilizing spring.

4. The device defined in claim 3, wherein said single stage first load spring includes a coil spring of a predetermined installed height.

5. The device defined in claim 4, wherein said single stage second load spring includes a coil spring of a predetermined installed height identical to that of said single stage first load spring.

6. The device defined in claim 5, wherein said two-stage third load spring includes:

(a) an outer coil spring of a predetermined installed height less than that of said single first or second load spring; and (b) a coaxial inner coil spring of a predetermined installed height equal to that of said single stage first or second load spring.

7. The device defined in claim 6, wherein said two-stage fourth load spring includes:

(a) an outer coil spring of a predetermined installed height less than that of said outer coil spring of said two-stage third load spring; and (b) a coaxial inner coil spring of a predetermined installed height equal to that of said single stage first or second load spring.

8. The device defined in any of claims 6 or 7, wherein:

(a) a retainer is operatively engaged with said outer coil;

(b) said coaxial inner coil spring is held in a coaxial relationship with said outer coil spring by said retainer; and (c) the installed height of said inner coil spring plus said retainer is equal to the installed height of said single stage first or second load spring.

9. The device defined in claim 8, wherein said retainer is in a mating helical relationship with said outer coil spring.

10. The device defined in claim 9, wherein each spring group has a total of seven load springs and two stabilizing springs.

11. The device defined in claim 10, and including a stabilizing structure for a railway spring suspension.

12. In combination with a railway car spring suspension, a railway car truck including a plurality of spring groups, a side frame on which said spring groups are supported and a bolster movable relative to said side frames and supported by said spring groups for transmitting the load weight of the car to said spring groups, each of said spring groups providing multiple effective spring rates by the use of a combination of single stage and two-stage springs operating in parallel, wherein each of said two-stage springs comprises an outer coil, a retainer integrally wound on the end of said outer coil, and an inner coaxial coil mounted on said retainer, said inner coil being under compression, the combination of said inner coil and retainer preventing lateral displacement of the outer coil.

13. The device defined in claim 12, wherein each of said spring groups includes:

(a) at least one single stage first load spring and at least one single stage second load spring which, in combination, provide adequate spring suspension for an empty car;

(b) at least one two-stage third load spring which, in combination with said single stage first and said single stage second load springs, provide adequate suspension for a loaded car;

(c) at least one two-stage fourth load spring which, in combination with said single stage first and second load springs and said two-stage third load spring provides a third phase of said multiple effective spring rate to control the dynamics of a loaded car; and (d) at least one stabilizing spring.

14. The device defined in claim 12, wherein said single stage first load spring incudes a coil spring of a predetermined installed height.

15. The device defined in claim 14, wherein said single stage second load spring includes a coil spring of a predetermined installed height indentical to that of said single stage first load spring.

16. The device defined in claim 15, wherein said two-stage third load spring includes:

(a) an outer coil spring of a predetermined installed height less than that of said single stage first or said second load spring; and (b) a coaxial inner coil spring of a predetermined installed height equal to that of said single stage first or second load spring.

17. The device defined in claim 16, wherein said two-stage fourth load spring includes:

(a) an outer coil spring of a predetermined installed height less than that of said outer coil spring of said two-stage third load spring; and (b) a coaxial inner coil spring of a predetermined installes height equal to that of said single stage first or second load spring.

18. The device defined in any one of claims 16 or 17, wherein:

(a) a retainer is operatively engaged with said outer coil;

(b) said coaxial inner coil spring is held in a coaxial relationship with said outer coil spring by said retainer; and (c) the installed height of said inner coil spring plus said retainer is equal to the installed height of said single stage first or second load spring.

19. The device defined in claim 18, wherein said retainer is in a mating helical relationship with said outer coil.

20. The device defined in claim 19, wherein each spring group has a total of seven load springs and two stabilizing springs.

21. The device defined in claim 20, and including a stabilizing structure for a railway spring suspension.

* * * * *